US008307658B2

(12) United States Patent
Bunel et al.

(10) Patent No.: US 8,307,658 B2
(45) Date of Patent: Nov. 13, 2012

(54) FLAME HOLDER FOR AN AFTERBURNER DUCT OF A JET ENGINE WITH A SPACER SHOE, AFTERBURNER DUCT, AND JET ENGINE COMPRISING AN AFTERBURNER DUCT

(75) Inventors: Jacques Marcel Arthur Bunel, Thiais (FR); Yann Francois Jean-Claude Vuillemenot, Paris (FR)

(73) Assignee: SNECMA, Paris (FR)

( * ) Notice: Subject to any disclaimer, the term of this patent is extended or adjusted under 35 U.S.C. 154(b) by 921 days.

(21) Appl. No.: 12/394,570

(22) Filed: Feb. 27, 2009

(65) Prior Publication Data

US 2009/0260366 A1 Oct. 22, 2009

(30) Foreign Application Priority Data

Feb. 29, 2008 (FR) ..... 08 01138

(51) Int. Cl.
*F02K 3/10* (2006.01)
*F02C 7/20* (2006.01)

(52) U.S. Cl. ..... 60/765; 60/761; 60/798

(58) Field of Classification Search ..... 60/761–764, 60/765–766, 796, 798, 799
See application file for complete search history.

(56) References Cited

U.S. PATENT DOCUMENTS

| | | | | |
|---|---|---|---|---|
| 3,465,525 | A * | 9/1969 | Cowley et al. | 60/762 |
| 3,698,186 | A | 10/1972 | Beane et al. | |
| 5,396,761 | A * | 3/1995 | Woltmann et al. | 60/39.827 |
| 5,396,763 | A * | 3/1995 | Mayer et al. | 60/765 |
| 2005/0252216 | A1 * | 11/2005 | Roche et al. | 60/765 |
| 2006/0016192 | A1 * | 1/2006 | Bunel et al. | 60/761 |
| 2007/0227151 | A1 * | 10/2007 | Bunel et al. | 60/761 |

FOREIGN PATENT DOCUMENTS

| | | |
|---|---|---|
| EP | 1 593 911 A1 | 11/2005 |
| EP | 1 840 469 A1 | 10/2007 |
| FR | 5.516.562 | 3/1968 |
| FR | 2 709 342 | 3/1995 |

* cited by examiner

*Primary Examiner* — William H Rodriguez
*Assistant Examiner* — Gerald Sung
(74) *Attorney, Agent, or Firm* — Oblon, Spivak, McClelland, Maier & Neustadt, L.L.P.

(57) ABSTRACT

A flame holder for an afterburner duct of a jet engine, including an arm in the form of a gutter forming a cavity, a shield for protecting the cavity of the arm from heat, and an air supply baffle housed in the cavity, is disclosed. The arm, the protective shield, and the air supply baffle are held together by a one-piece spacer shoe.

11 Claims, 4 Drawing Sheets

FLAME HOLDER FOR AN AFTERBURNER DUCT OF A JET ENGINE WITH A SPACER SHOE, AFTERBURNER DUCT, AND JET ENGINE COMPRISING AN AFTERBURNER DUCT

BACKGROUND OF THE INVENTION AND DESCRIPTION OF THE PRIOR ART

The present invention relates to the field of jet engines comprising an afterburner duct for reheating the gases emanating from the gas generator.

Jet engines with afterburners comprise, from upstream to downstream, a gas generator, consisting of a gas turbine engine, producing gases heated by combustion, an afterburner duct, and an exhaust nozzle for exhausting the gases into the atmosphere. The engine is usually of the double-flow type, with a central primary flow and a peripheral secondary flow.

The afterburner duct is provided with a liner made of a material which is resistant to the gas combustion temperature, said liner being suitably cooled. At the inlet of the duct, fuel injection means are arranged in the gas flow path, combined with means forming flame holders.

With reference to FIG. 1, the flame holder means 10 are in the form of radial arms which are arranged in a star pattern with respect to the engine axis and which pass through the two flow paths for the primary and secondary flows, said arms being connected to one another by elements in the form of annular sectors 9. With reference to FIG. 2, the integrally cast arms 100 in the form of gutters have a U- or V-shaped cross section which is open in the downstream direction so as to create a negative pressure region capable of stabilizing the combustion therein. In at least part of the flame holders 10, fuel injectors 130 are placed inside within the cavity formed between the walls, upstream and in the vicinity of the apex, together with air ventilation baffles 120. Air is bled from the secondary flow and distributed by the baffles 120 toward the injectors 130. In order to protect these elements, a protective heat shield 110 is placed as a covering over this part of the arm 100 containing the fuel injectors 130 and the ventilation baffle 120.

Traditionally, as represented in FIG. 2, the air ventilation baffle 120 is centered at its upper part and at its lower part in the cavity of the arm 100. It is held in a radial position via a tenon 5 on the base of the tube which passes through the protective heat shield 110 and thereby rotationally immobilizes the baffle 120 in the arm 100.

However, it is not desirable to weaken the heat shield 110 by piercing it in order to retain the air baffle 120. Specifically, the protective heat shield 110, which is generally made of CMC (ceramic matrix composite), is damaged by peening and delamination, something which is particularly detrimental during vibratory operation.

Similarly, piercing and machining operations performed on protective metal shields lead to a concentration of stresses, thereby reducing the efficiency and useful life of said shields.

It is also known practice to pierce the arm 100 at its lower end so as to introduce there the air ventilation baffle 120, which is fastened via a washer 16 welded to the lower end of the air ventilation baffle 120, outside the arm 100, as represented in FIG. 3.

This alternative is not satisfactory since it requires piercing the arm 100 and therefore entails all of the disadvantages mentioned above.

SUMMARY OF THE INVENTION

In order to rectify at least some of these disadvantages, the Applicant proposes an afterburner flame holder which does not require performing machining operations on the body of the arm 100 and/or on the heat shield 120 that mechanically and/or thermally weaken the flame holder. Such a flame holder is simple in design and easy to assemble, thereby reducing its production cost. Moreover, it offers increased thermal resistance and mechanical strength owing to the absence of weak spots.

The invention relates to a flame holder for an afterburner duct of a jet engine, comprising an arm in the form of a gutter forming a cavity, a shield for protecting the cavity of the arm from heat, and an air supply baffle housed in the cavity, wherein the arm, the protective shield and the air supply baffle are held together by a one-piece spacer shoe comprising at least one spacer lug designed to form a gap (e) between the protective heat shield and at least one wall of the arm.

Such a shoe makes it possible to maintain separations between the various elements, thus preventing wear during a vibratory operation.

The gap-producing lug advantageously makes it possible to form a channel between the protective shield and the arm so as to allow carbureted air to pass through.

Preferably still, the shoe comprises a means for retaining the baffle.

The shoe advantageously makes it possible to retain the baffle without weakening the arm or its protective heat shield.

According to one embodiment of the invention, a fuel injector is placed inside said cavity of the arm.

Preferably, the shoe comprises a means for centering the injector.

The shoe advantageously makes it possible to center the injector without weakening the arm or its protective heat shield. That makes it possible, advantageously still, to maintain a constant distance between the injector and the air baffle, thereby facilitating the distribution of air from the air baffle toward the injectors.

Preferably, the shoe is welded to the air supply baffle, thus making it possible to avoid any translational movement of the baffle in the arm.

Preferably still, the shoe takes the form of a Y defining a central branch and two lateral branches, the central branch comprising a through orifice for retaining the baffle.

The shape of the shoe advantageously makes it possible to overcome differential expansions between the arm and the shoe.

The through orifice for retaining the baffle advantageously makes it possible to guide and to lock the air baffle.

Preferably still, the central branch comprises a through orifice for centering the injector.

The invention relates to a jet engine afterburner duct comprising at least one such flame holder.

The invention also relates to a jet engine comprising such an afterburner duct.

BRIEF DESCRIPTION OF THE DRAWINGS

The invention will be better understood with reference to the appended drawings, in which.

DESCRIPTION OF THE PREFERRED EMBODIMENTS

Figure 1:
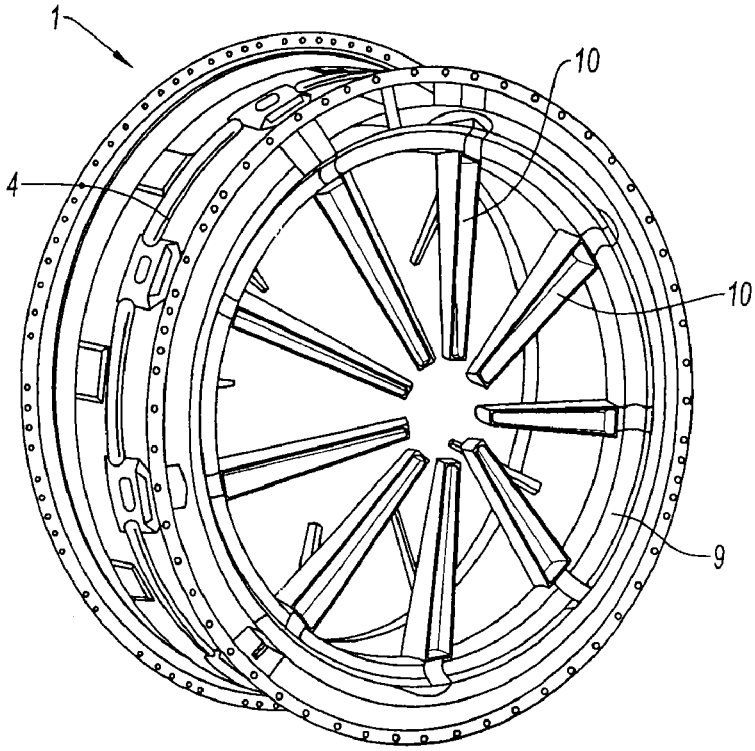
Fig. 1 BACKGROUND ART
FIG. 1 represents a perspective view of an afterburner case with flame holders.
Figure 2:
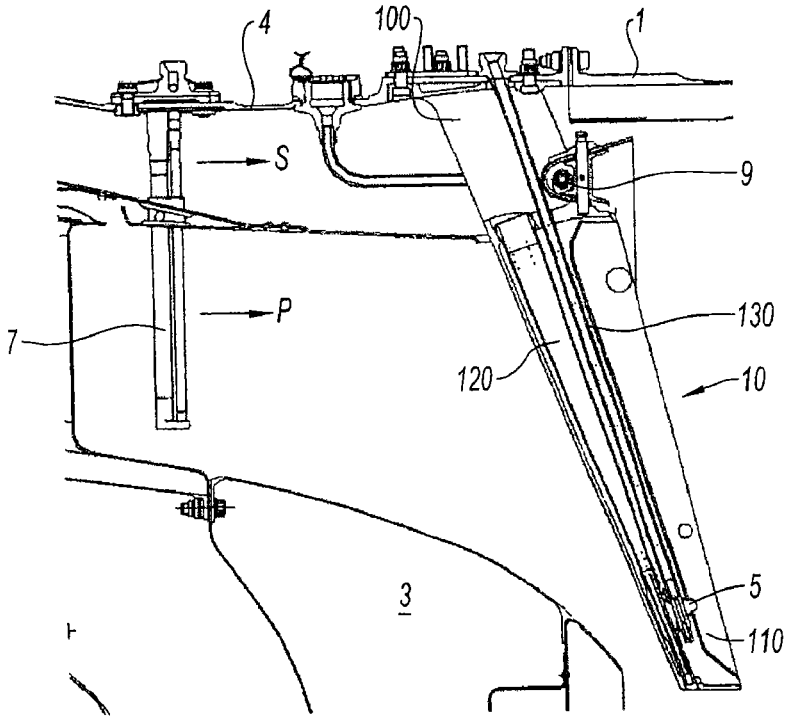
Fig. 2 BACKGROUND ART
FIG. 2 represents a sectional view of part of a turbofan engine with a flame holder according to a first prior art.
Figure 3:
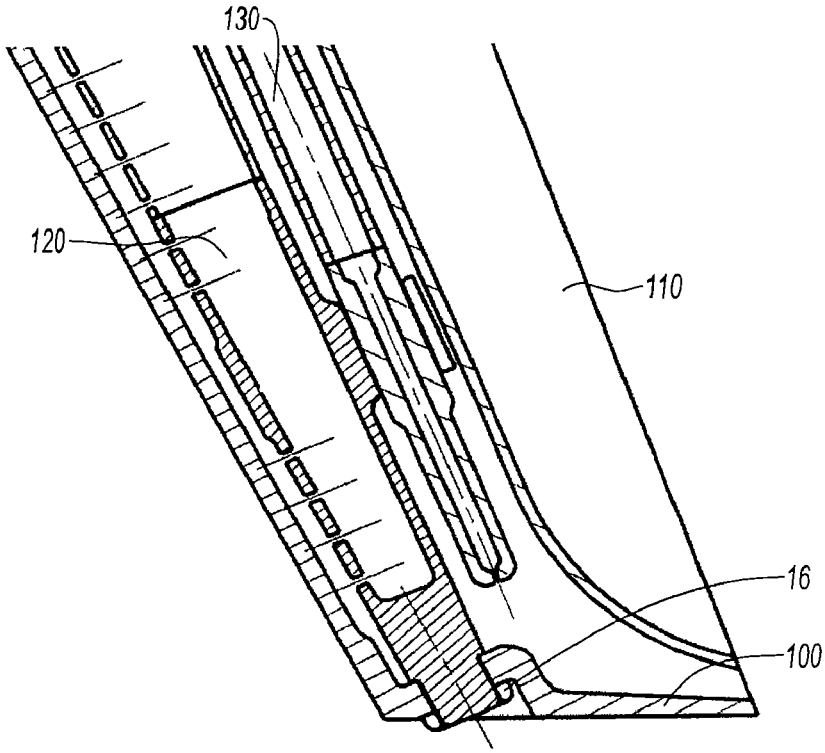
Fig. 3 BACKGROUND ART
FIG. 3 represents a sectional view of the lower part of a flame holder according to a second prior art.

FIG. 2 represents part of a turbofan engine. All that can be seen of this engine is the ogive shape of the exhaust case 3 at the rear of the gas turbine engine, inside the outer cylindrical casing 4. The engine supplies a hot primary gas flow, represented by the arrow P, at the outlet of the turbine of the gas turbine engine. Some of the air sucked in by the engine is simply compressed and bypasses the combustion chamber of the engine. This air constitutes the secondary flow, represented by the arrow S. The two flows here mix downstream of a confluence section formed by an annular metal sheet.

This engine section is extended, particularly in military-type aircraft, by a cylindrical afterburner duct 1 for reheating the gases that is situated ahead of the exhaust nozzle. The upstream part of the afterburner duct 1 is shown, but not the nozzle. In certain flight phases, it is necessary to supply additional energy to the gases producing the thrust. This is provided by reheating, or afterburning, the gases in the afterburner duct. Fuel is injected into the gases by injectors like those represented at 7, radially passing through the two, primary and secondary, flow paths. Downstream of these injectors, means forming flame holders 10 are configured so as to allow the gases to be retained during their combustion. These means comprise partly rectilinear flame holders 10 arranged radially in a star pattern in a plane substantially perpendicular to the engine axis, in this case immediately downstream of the confluence of the two primary and secondary flows. They are connected by arms 9 in the form of a ring sector which, in this type of afterburner device, are on the secondary flow path side.

Figure 4:
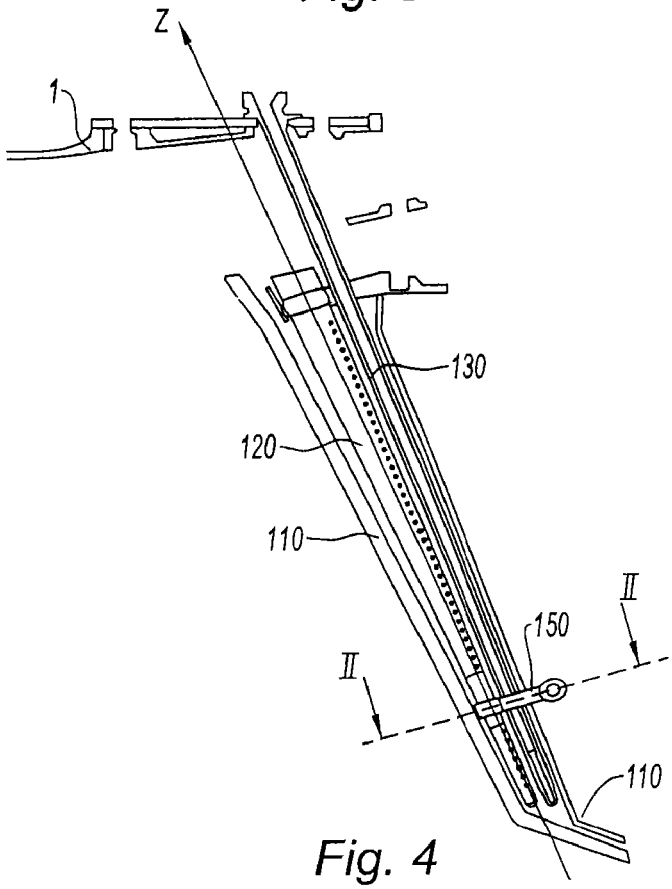
FIG. 4 represents a sectional view of a flame holder according to the invention.

With reference to FIG. 4, the radial flame holders 10 are formed by radial arms 100 in the form of gutters, with a V or U-shaped cross section, whose apex faces in the upstream direction with respect to the gas flow direction. The structure of the flame holder 10 is visible from the sectional view in FIG. 5 in the direction II-II shown in FIG. 4. The arm 100 defines a cavity, between the upstream apex and the free downstream edges of the two walls 101*a* and 101*b*, which is occupied by a baffle 120 which supplies air bled from the flow path for the secondary flow, a tubular fuel injector 130, and a protective heat shield 110. The shield 110 is in the form of a curved metal sheet whose concave side faces in the downstream direction.

The air supply baffle 120, the tubular fuel injector 130 and the protective heat shield 110 are held in the arm 100, at the top, in the afterburner case and, at the bottom, by a spacer shoe 150 whose function is to prevent them from coming into contact, in particular during vibratory operation. The shoe 150 makes it possible to fasten the air supply baffle 120 and the injector 130 in the arm 100 without the need for piercings in thermally stressed regions of both the shield 110 and the arm 100, thus making it possible to limit wear.

In this example, the arm 100 and the tubular fuel injector 130 are directly fastened in the afterburner case.

Figure 6:
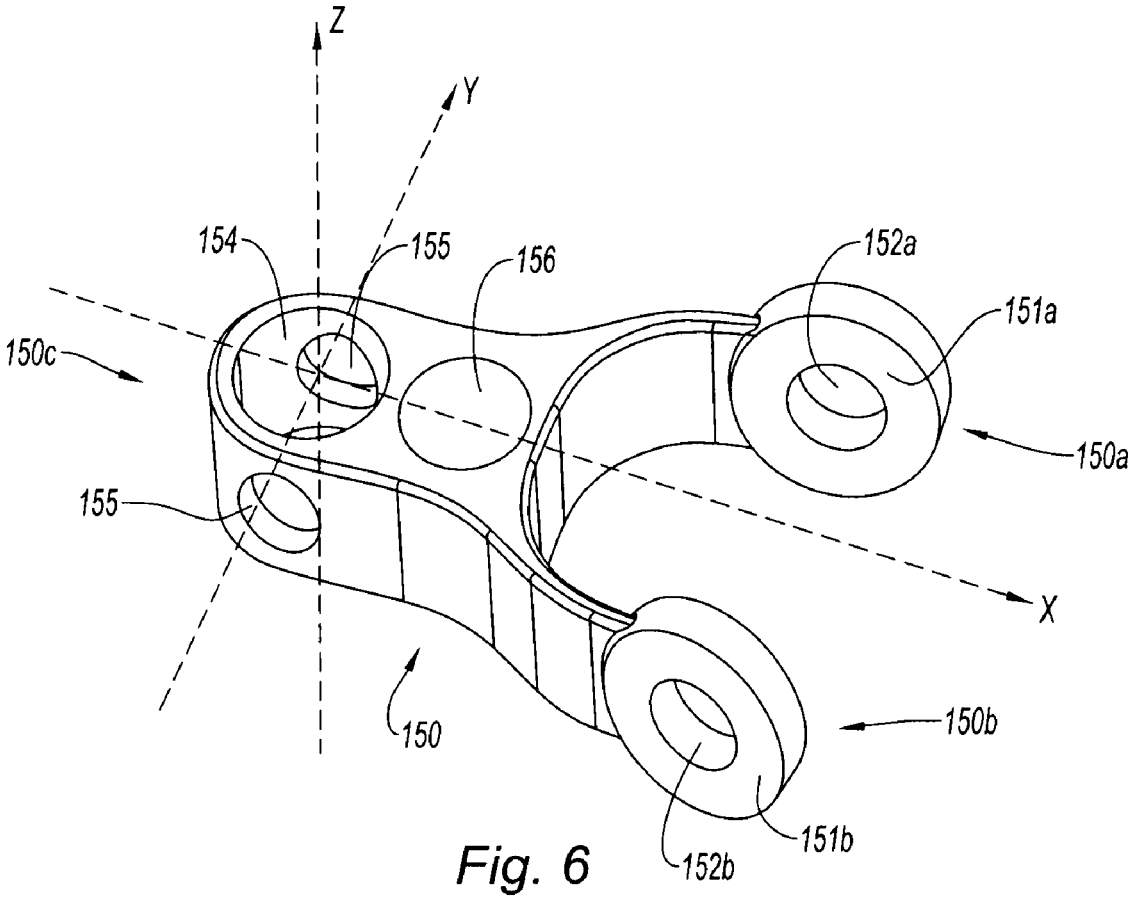
FIG. 6 represents a perspective view of a spacer shoe according to the invention.

With reference to FIG. 6, the spacer shoe 150 substantially takes the form of a Y comprising a central branch 150*c*, extending lengthwise in a direction X, from which there extend two substantially parallel lateral branches 150*a*, 150*b*. Each lateral branch 150*a*, 150*b*, extending in the direction X, is terminated at its end by a circular spacer lug 151*a*, 151*b* each comprising a fastening orifice 152*a*, 152*b* formed in the lateral branch 150*a*, 150*b* in a direction Y orthogonal to the direction X.

The lateral branches 150*a*, 150*b* have a small thickness so as to make it possible to overcome differential expansions between the arm 100 made of CMC and the shoe 150 made of metal. This equally applies to an arm made of a metal material, with differential expansions occurring due to temperature differences between the metal components.

The central branch 150*c* of the spacer shoe 150, which is wider than the lateral branches 150*a*, 150*b*, is pierced at two locations within its thickness in a direction Z. A first retaining through orifice 154 is formed at the base of the central branch 150*c* and is intended to retain an axial portion of the air supply baffle 120. This orifice will be designated hereinafter as baffle retention orifice 154. A second retaining through orifice 156 is formed in the central branch 150*c*, between the baffle retention orifice 154 and the lateral branches 150*a*, 150*b*. This orifice 156 is intended to center the tubular fuel injector 130 in the arm 100. This orifice will be designated hereinafter as injector centering orifice 156.

Still with reference to FIG. 6, the spacer shoe 150 also comprises locking through orifices 155 formed within the width of the central branch 150*c* in the direction Y, orthogonally to the baffle retention orifice 154. Thus, with reference now to FIG. 7, when the air supply baffle 120 is introduced into the spacer shoe 150 via its baffle retention orifice 154, the outer surface of the baffle 120 is visible via the locking orifices 155, the function of which will be described in detail hereinafter.

The invention will be understood better still from the description of the mounting of the spacer shoe 150 in the arm 100, as represented in FIGS. 4, 5, 7, 8*a* and 8*b*.

Figure 7:
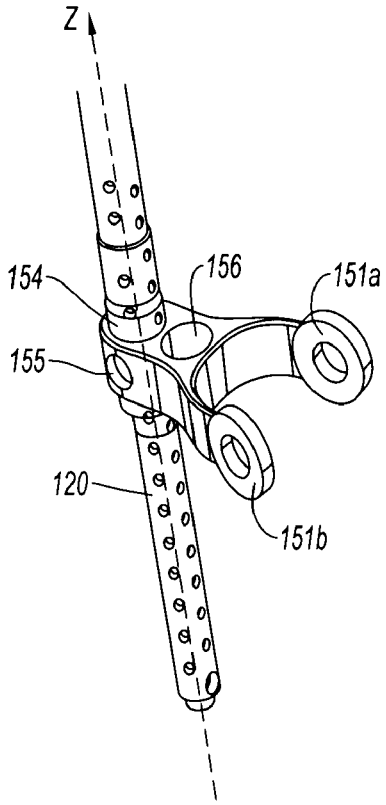
FIG. 7 represents a perspective view of the shoe in FIG. 6, retaining an air supply baffle.
Figure 8A:
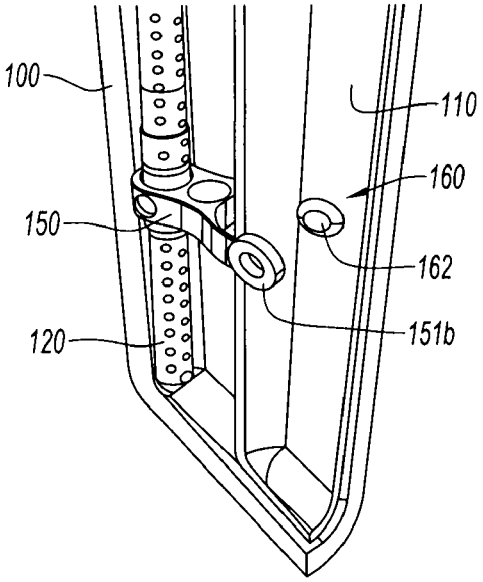
FIG. 8A represents a partial perspective view of the shoe and the baffle in FIG. 7, which are mounted in a flame holder.
Figure 8B:
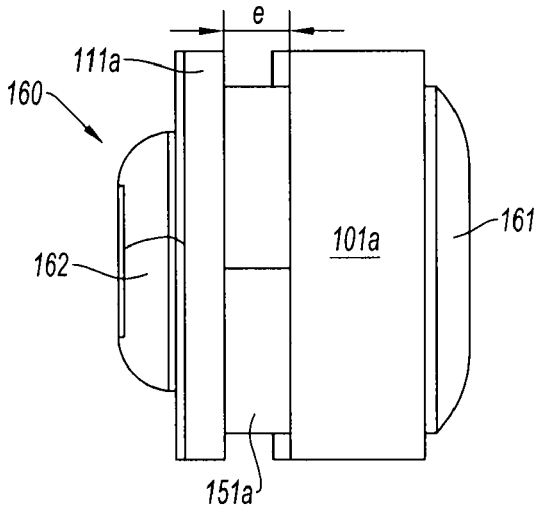
FIG. 8B is a close-up view of FIG. 8A representing the connection, produced by the shoe, between a flame holder arm and its protective heat shield.

With reference to FIG. 4, the air supply baffle 120 and the tubular fuel injector 130 are centered, at the top, in the flame holder 10 and held, at the bottom, by the spacer shoe 150. In this example, the air baffle 120 comprises, at the top, a swiveling head enabling it to be centered in the arm. The air supply baffle 120 is introduced axially, in the direction Z, into the spacer shoe 150 via its baffle retention orifice 154 and is locked axially with the shoe 150 by welding. During the welding step, material is applied to the outer surface of the baffle 120, which is visible via the locking orifices 155. The air baffle 120 is then fixedly retained by the shoe 150, as represented in FIG. 7.

The tubular fuel injector 130 is, for its part, introduced axially in the direction Z into the injector centering orifice 156 in order to maintain it at a distance from the air supply baffle 120. The distance between the baffle 120 and the injector can be set by adapting the spacing between the injector centering orifice 156 and the baffle retention orifice 154 of the shoe 150.

Figure 5:
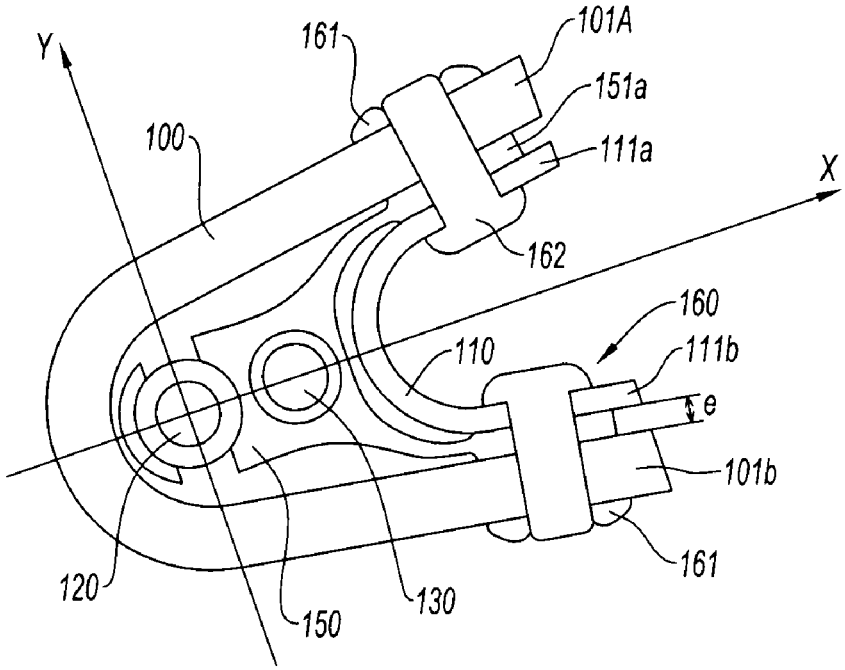
FIG. 5 represents a sectional view of the flame holder in FIG. 4 in the direction II-II.

During the mounting operation, the circular gap-producing lugs 151*a*, 151*b* of the spacer shoe 150 are arranged between the walls of the protective shield 110 and the walls of the arm 100. With reference to FIG. 5, the lug 151*a* is interposed between the wall 111*a* of the protective shield 110 and the wall 101*a* of the arm 100, the thickness of the lug 151*a* defining a gap thickness (e) between said walls 101*a*, 111*a*. The gap (e) forms a channel allowing carbureted air to pass through.

For each spacer lug of the shoe 150, a cylindrical stud 160 successively passes through the wall 111*a* of the shield 110, the fastening orifice 152*a* of the lug, and the wall 101*a* of the arm 100. The stud 160 is retained by a washer 161 welded to the outside of the arm 100. The assembly formed by the wall 101*a* of the arm 100, the wall 111*a* of the shield 110 and the lug 151*a* is held clamped between the welded washer 161 and the head 162 of the cylindrical stud.

It goes without saying that other fastening means could also be suitable, such as those described in application FR0655241.

What has been described is the mounting of a protective heat shield on a flame holder of rectilinear shape. The invention is not limited to this application. This type of mounting is also valid for mounting a protective heat shield in a flame holder in the form of a ring sector such as those connecting the radial arms.

The invention claimed is:

1. A flame holder for an afterburner duct of a jet engine, comprising:

an arm in the form of a gutter forming a cavity;

a shield for protecting the cavity of the arm from heat; and an air supply baffle housed in the cavity, wherein the arm, the protective shield and the air supply baffle are held together by a one-piece spacer shoe comprising a central branch, at least one lateral branch extending axially from the central branch, and at least one spacer lug disposed at an end of the at least one lateral branch designed to form a gap between the protective heat shield and at least one wall of the arm, the spacer lug including a fastening orifice, and a stud passes through the at least one wall of the arm, the fastening orifice, and the protective heat shield.

2. The flame holder as claimed in claim 1, wherein the shoe comprises a means for retaining the air supply baffle.

3. The flame holder as claimed in claim 1, wherein a fuel injector is placed inside said cavity of the arm.

4. The flame holder as claimed in claim 3, wherein the shoe comprises a means for centering the injector.

5. The flame holder as claimed in claim 4, wherein the shoe comprises a means for retaining the air supply baffle.

6. The flame holder as claimed in claim 1, wherein the shoe is welded to the air supply baffle.

7. A jet engine afterburner duct comprising at least one flame holder as claimed in claim 1.

8. A jet engine comprising an afterburner duct as claimed in claim 7.

9. The flame holder as claimed in claim 1, wherein a thickness of the at least one lateral branch is less than a thickness of the central branch.

10. A flame holder for an afterburner duct of a jet engine, comprising:

an arm in the form of a gutter forming a cavity;

a shield for protecting the cavity of the arm from heat; and an air supply baffle housed in the cavity, wherein the arm, the protective shield and the air supply baffle are held together by a one-piece spacer shoe comprising at least one spacer lug designed to form a gap between the protective heat shield and at least one wall of the arm, and wherein the shoe takes the form of a Y defining a central branch and two lateral branches, the central branch comprising a through orifice for retaining the air supply baffle.

11. The flame holder as claimed in claim 10, wherein a fuel injector is placed inside said cavity of the arm, the central branch comprising a through orifice for centering the injector.

* * * * *

UNITED STATES PATENT AND TRADEMARK OFFICE

CERTIFICATE OF CORRECTION

PATENT NO. : 8,307,658 B2
APPLICATION NO. : 12/394570
DATED : November 13, 2012
INVENTOR(S) : Jacques Marcel Arthur Bunel et al.

It is certified that error appears in the above-identified patent and that said Letters Patent is hereby corrected as shown below:

Title Page, under Foreign Patent Documents, change "FR 5.516.562 3/1968" to --FR 1 516 561 3/1968--.

Signed and Sealed this
Fifth Day of February, 2013

Teresa Stanek Rea
*Acting Director of the United States Patent and Trademark Office*